US005803101A

United States Patent [19]

Gallo

[11] Patent Number: 5,803,101

[45] Date of Patent: Sep. 8, 1998

[54] PORTABLE DRAIN CLEANING APPARATUS

[75] Inventor: Charles V. Gallo, Blacksburg, Va.

[73] Assignee: CDC Products, Inc., Blacksburg, Va.

[21] Appl. No.: 712,192

[22] Filed: Sep. 11, 1996

[51] Int. Cl.[6] ..... B08B 9/02; B08B 5/00

[52] U.S. Cl. ..... 134/166 C; 134/24; 134/22.12; 4/255.06; 15/406

[58] Field of Search ..... 134/99.2, 166 C, 134/22.12, 24, 100.1, 102.1, 167 C, 168 C, 169 C, 22.11, 22.14, 17; 4/255.04, 255.06, 255.09; 15/406, 407; 222/5, 6, 4

[56] References Cited

U.S. PATENT DOCUMENTS

| | | | |
|---|---|---|---|
| 1,537,313 | 5/1925 | Koudelka | 15/406 |
| 2,016,498 | 10/1935 | Hopewell | 4/256 |
| 2,284,805 | 6/1942 | Decker | 15/406 |
| 2,300,319 | 10/1942 | Smith | 4/255 |
| 2,939,154 | 6/1960 | Gasser | 4/255 |
| 3,138,803 | 6/1964 | Caplan et al. | 4/255 |
| 3,139,238 | 6/1964 | Norstrud et al. | 134/99.2 |
| 3,156,584 | 11/1964 | Yurdin | 134/17 |
| 3,280,419 | 10/1966 | Frohlich | 15/406 |
| 3,608,098 | 9/1971 | Andrisani | 4/255.04 |
| 3,707,301 | 12/1972 | Rauls | 4/255.04 |
| 3,789,861 | 2/1974 | Conn et al. | 134/166 C |
| 3,823,427 | 7/1974 | Pittet | 4/255 |
| 3,879,771 | 4/1975 | Nakane | 4/255 |
| 4,034,427 | 7/1977 | Breznock et al. | 4/255 |
| 4,059,858 | 11/1977 | Lambel et al. | 4/255 |
| 4,063,317 | 12/1977 | Santore | 4/255 |
| 4,321,712 | 3/1982 | Dixon | 4/256 |
| 4,420,852 | 12/1983 | Bowlsby | 134/166 C |
| 4,791,946 | 12/1988 | Cavanaugh et al. | 134/166 C |
| 5,029,594 | 7/1991 | Pierce, Jr. | 134/166 C |
| 5,249,311 | 10/1993 | Rau | 4/255.05 |
| 5,530,988 | 7/1996 | McQuillan | 15/406 |

*Primary Examiner*—Amy B. Vanatta
*Attorney, Agent, or Firm*—Everett G. Diederiks, Jr.

[57] ABSTRACT

A readily transportable, compact and self-contained drain cleaning apparatus includes a hand-held control housing that is provided with an internal passage into which a release member and an adjustable regulating unit extend at spaced intervals such that a fluid chamber is defined between the release member and the regulating unit within the internal passage. The control housing includes a cartridge housing portion for attaching a miniature cartridge, containing a pressurized gaseous medium and preferably either a drain cleaning or algaecide fluid, thereto with an interior of the cartridge opening into the internal passage downstream of the regulating unit. Upstream of the release member, the control housing has an elongated tube attached thereto and the tube has an end, remote from the control housing, provided with a terminal discharge member that is adapted to be sealingly engaged with an open portion of a clogged drain conduit. With this construction, shifting of the release member causes a supply of pressurized fluid, delivered into the fluid chamber from the pressurized cartridge through the regulating unit, to flow through the tube and terminal discharge member and into the drain conduit as a momentary burst of pressurized fluid while the regulating unit retards a flow of additional pressurized fluid from the cartridge to the fluid chamber.

20 Claims, 3 Drawing Sheets

2
47
18
73
49
45
19
25
5
63
55
60
50
15
53
8
21
29
27
31
11
126
124
70
97
105
108
100
93
83
86
111
88
80

PORTABLE DRAIN CLEANING APPARATUS

BACKGROUND OF THE INVENTION

1. Field of the Invention

The present invention pertains to the art of plumbing and, more specifically, to a portable drain cleaning apparatus that is particularly adapted for use in cleaning condensation drains associated with air conditioning and other refrigeration units, but which could also be used in other plumbing applications. The invention is further directed to a cartridge containing a pressurized gas, as well as a drain cleaner or algaecide, for use in combination with the drain cleaning apparatus.

2. Discussion of the Prior Art

Over the years numerous devices has been utilized in connection with the clearing of clogged drains. For example, it has heretofore been known to attach one end of a hose to a sink faucet and to place the other end of the hose, in a generally sealed manner, within a clogged drain in order to cause pressurized water to flow through the hose once the faucet is opened in an attempt to remove any obstructions. Unfortunately, such a simply arrangement rarely works, even on drains having relatively minor obstructions therein. In an attempt to enhance such a known system, it has also been proposed to place a container housing a drain cleaning fluid in series with the hose in order to introduce an additional cleaning enhancing substance within the clogged drain. This known prior art arrangement generally has associated therewith a level of effectiveness commensurate with simply pouring the cleaning enhancing substance directly down the drain.

Various other drain cleaning devices have also been proposed which incorporate auxiliary pressure sources. For instance, it is known to utilize a miniature gas cartridge in combination with a plunger-type drain cleaning unit to create a high pressure force to dislodge an obstruction within a drain. Actually, standard plunger-type drain cleaning units are essentially just as effective on almost all clogs experienced in these particular types of drains. In addition, such known arrangements are only useful in limited applications due to their size and overall configuration. In essence, these known arrangements are only functional in cleaning standard sink drains and toilets. One particular environment wherein such prior art arrangements are not functional is in cleaning condensate drains. The main reason why these prior art arrangements are not utilized in connection with condensation drain clogs is the inaccessibility of condensate drains in general. Usually such drains are located in confined areas in attics or basements and the inlet openings thereto are often located directly adjacent a cooling coil or other structure which provides for extremely limited access.

Because of these and other shortcomings of prior known systems, until just recently, the most common method for cleaning condensation drains, particularly in air conditioning or other types of refrigeration units, has been to force a flow of freon from a pressurized container through the clogged drain. However, with the enactment of new regulations by the Environmental Protection Agency (EPA), the use of freon-based cleaning systems has been made illegal. In the aftermath of these regulation changes, it has become commonly known to simply utilize a rather large, pressurized air or nitrogen tank having an attached hose, the free end of which can be positioned at the opening of a condensate drain conduit such that opening of a valve on the tank will force pressurized gas to be injected into the conduit. However, as indicated above, such drain conduits are often found in confined areas and the lugging of these heavy tanks is not only extremely inconvenient but sometimes dangerous. In addition, it is extremely difficult, if not impossible, to regulate or determine the exact amount of pressurized gas that is released in any given application such that the customer is generally charged for a greater percentage of the pressurized gas than is actually dispensed.

In view of the above, it should be readily apparent that there exists a need in the art of plumbing for a drain cleaning apparatus that is compact and lightweight so as to be readily portable, is designed to be easily maneuvered so it can be used in various plumbing environments and particularly in cleaning hard to access condensate drain conduits, which is cost effective to make and utilize and is consumer conscious in nature.

SUMMARY OF THE INVENTION

The present invention pertains to a portable drain cleaning apparatus including a control housing having a fluid passage in a main body portion thereof. The control housing is sized to be grasped by and easily held in a user's hand such that an extremely compact and readily transportable unit is provided. A release valve member and a regulating unit are attached to the control housing and extend into the fluid passage, preferably at spaced intervals along the length of the control housing such that a chamber is defined within the fluid passage between the release valve member and the regulating unit. A first end portion of a flexible, tubular member is attached to the control housing, downstream of the release valve member, and a second end portion of the flexible, tubular member is provided with a terminal discharge member. A pressurized gas container is removably secured to the control housing with the interior of the container opening into the fluid passage downstream of the regulating unit.

With this arrangement, the flexibility of the tubular member enables the terminal discharge member to be easily manipulated and positioned into a clogged drain, even condensate drain conduits which often have only a few inches of clearance between an opening of the drain conduit and additional refrigeration structure. Once the pressurized container is in place, actuation of the release member will cause a supply of pressurized fluid, delivered into the fluid chamber from the pressurized container and the regulating unit, to flow through the tubular member and to exit the terminal discharge member as a momentary burst. Meanwhile, the regulating unit, which is preferably manually adjustable, retards a flow of additional pressurized fluid from the pressurized fluid container into the fluid chamber.

With this construction, the drain cleaning apparatus of the invention is readily portable, can be maneuvered to access portions of clogged drain conduits even through potentially meandering paths and can be easily adjusted to control the amount of pressurized fluid that is discharged therefrom. The actual structure of the control housing, release valve member, regulating unit, tubular member, terminal discharge member and pressurized container can vary without departing from the invention. The pressurized container is preferably constituted by a miniature gas cartridge that may contain, in addition to the gaseous medium, a drain cleaning fluid and/or an algaecide. The control housing also preferably comprises a removable cartridge housing portion which is adapted to receive the miniature cartridge and is removably attached to the main body portion, as well as a puncture element which automatically opens the interior of the cartridge to the fluid passage upon assembly of the cartridge housing to the main body portion. The terminal discharge member is preferably constituted by an elastomeric fitting that either tapers or is expandable to be effectively sealed to the drain conduit.

Additional features and advantages of the drain cleaning apparatus constructed in accordance with the invention will become more readily apparent from the following detailed description of preferred embodiments thereof when taken in conjunction with the drawings wherein like reference numbers refer to corresponding parts in the several views.

DETAILED DESCRIPTION OF THE PREFERRED EMBODIMENTS

Figure 1:
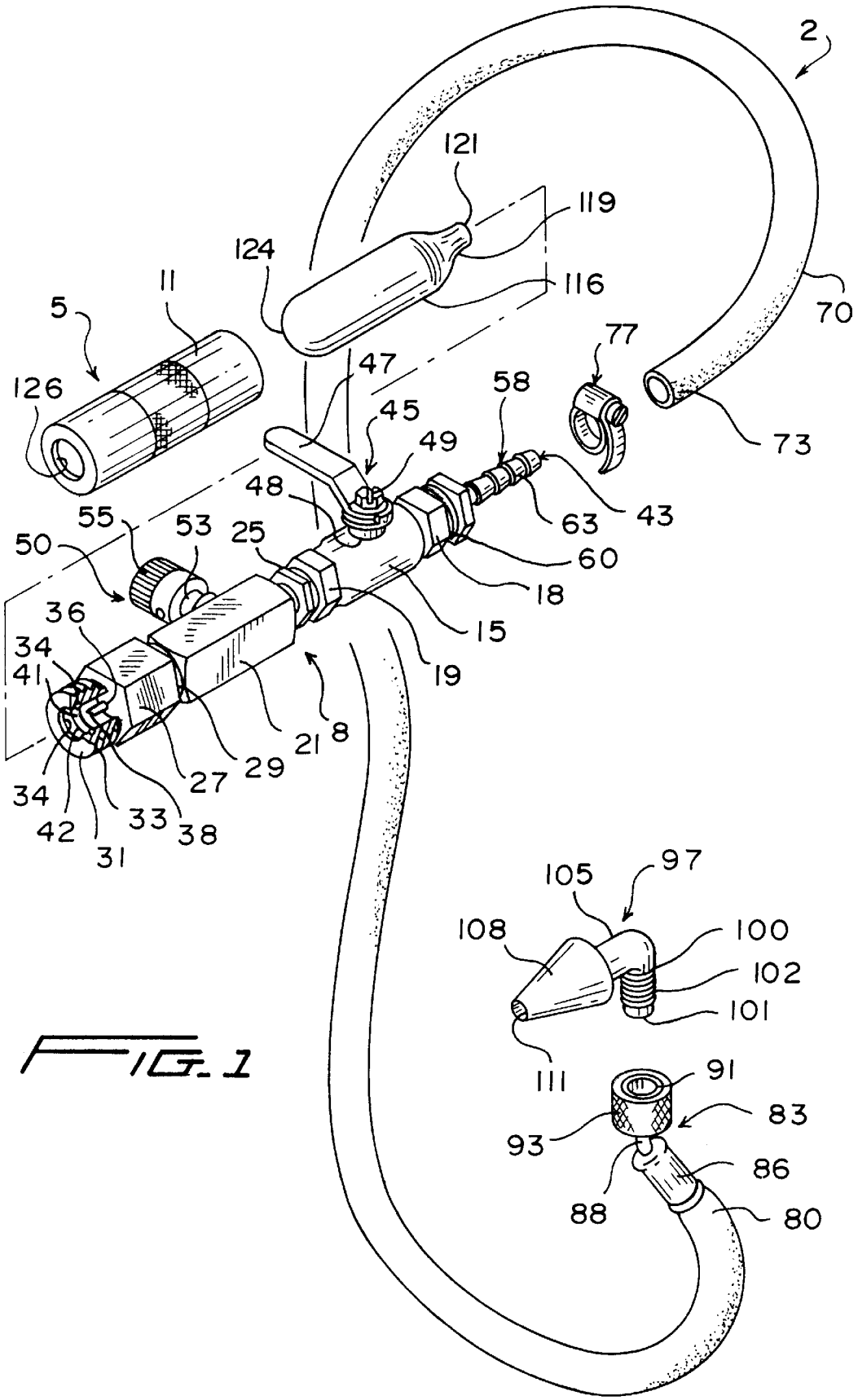
FIG. 1 is a partial exploded view of a drain cleaning apparatus constructed in accordance with a first preferred embodiment of the invention.
Figure 2:
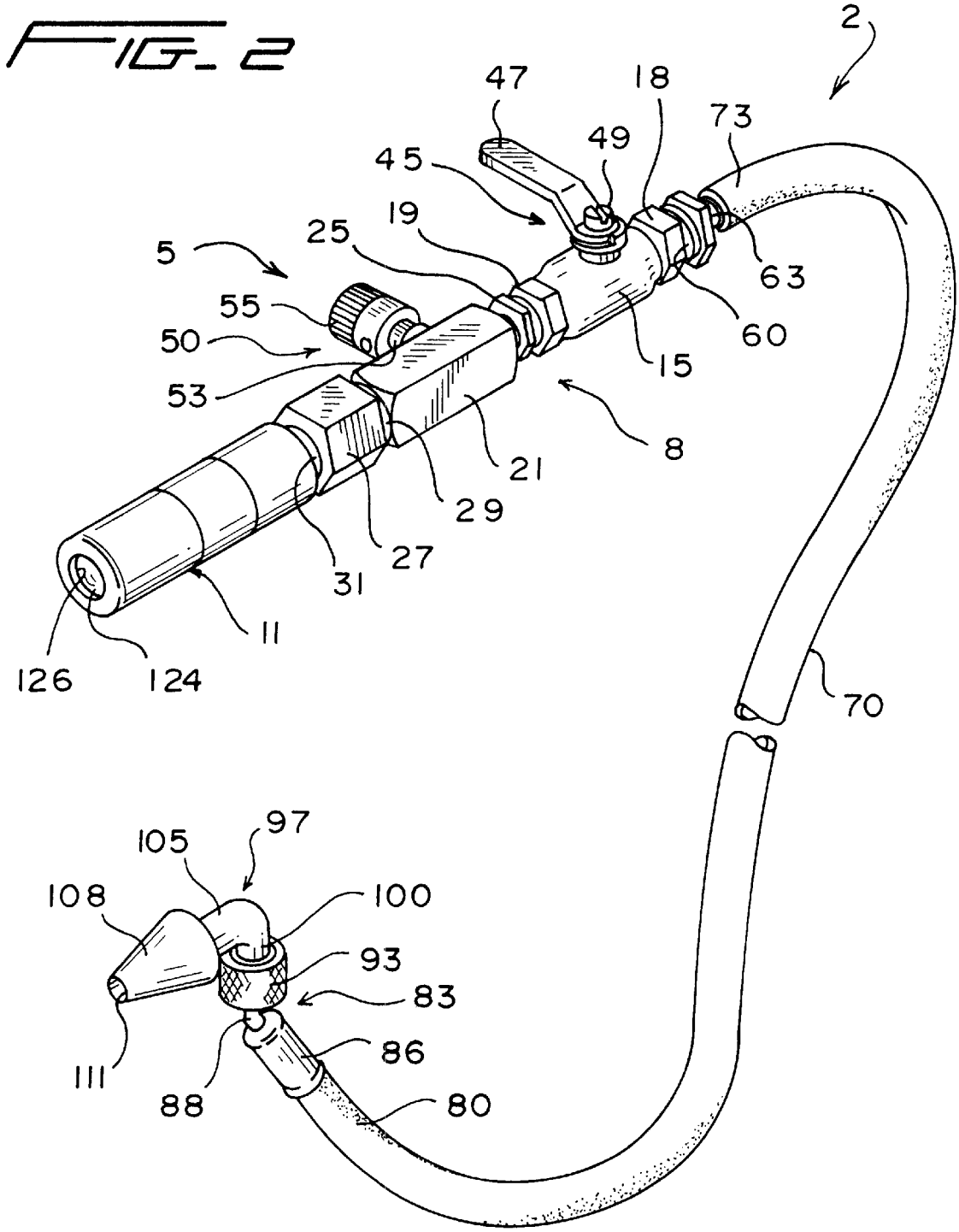
FIG. 2 is a perspective view of the drain cleaning apparatus of FIG. 1 in an assembled state.

With initial reference to FIGS. 1 and 2, the drain cleaning apparatus constructed in accordance with a first preferred embodiment of the invention is generally indicated at 2. Drain cleaning apparatus 2 includes a control housing 5 composed of a main body portion 8 and an attachable cartridge housing 11. Main body portion 8 is defined by a first section 15 having internally threaded end portions defined within integrally formed nut members 18 and 19; a second section 21 which constitutes a regulator housing section that also has internally threaded ends (not separately shown); a double-end connector 25 which threadably interconnects first and second sections 15 and 21; and a third section 27. Third section 27 has a first end 29 which is threadably or otherwise attached to second section 21 and a second end 31 that is externally threaded at 33 (see FIG. 2). Second end 31 is provided with a receiving opening 34 that leads to a puncture member 36 having a sharpened, self-piercing tip 38. Second end 31 is further provided, within receiving opening 34, with an O-ring 41 that is seated within an annular groove 42 formed within second end 31 of third control housing section 27. As will be more fully discussed below, control housing 5 has a fluid passage 43 extending there through. Therefore, puncture member 36 is tubular in construction and each of first, second and third sections 15, 21 and 27 is bored such that these elements collectively define fluid passage 43.

First section 15 carries a release valve member generally indicated at 45. In the preferred embodiment shown in these Figures, release valve member 45 constitutes a rotary valve having a manually engageable lever 47 that is attached to a stem portion 48 of the valve by means of a screw 49. Release valve member 45 is preferably constituted by an ON/OFF valve such that when release valve member 45 is in a first position as shown in these figures, fluid passage 43 is closed and therefore fluid is prevented from flowing through fluid passage 43. However, when release valve member 45 is rotated to a second position, fluid will be permitted to flow within fluid passage 43.

As mentioned above, second section 21 actually defines a regulator section having a regulating unit 50. Regulating unit 50 includes a regulating element (not shown) positioned within fluid passage 43, at a location spaced by a fluid chamber portion of fluid passage 43 from release valve member 45, and a rotary regulating stem 53 that is attached to the regulating element. Stem 53 has attached thereto a control knob 55 which can be manually adjusted to regulate the supply of pressurized fluid downstream thereof within fluid passage 43 as will be more fully discussed below. At this point, it should be noted that the particular type of regulating unit 50 incorporated in the drain cleaning apparatus 2 of the invention can vary. For instance, regulating unit 50 can comprise a flow regulating valve, a pressure control valve or a variable restriction without departing from the spirit of the invention. In addition, it should be noted that, although control housing S has been shown and described as being formed from various interconnected component sections, control housing 5 could equally be formed as a unitary housing having release member 45 and regulating unit 50 simply mounted thereto. The preferred embodiment presented in the drawings advantageously illustrates a form of the invention which can be readily assembled from existing parts. For example, in the embodiment shown in these figures, release valve member 45 comprises a TEEL or SPEEDAIRE ball-type gate valve and regulating unit 50 comprises a readily available PARKER flow control valve.

Attached to first section 15 of control housing 5, at an end remote from second section 21, is a terminal connector 58. More specifically, terminal connector 58 includes a threaded end 60 received within internally threaded nut member 18 and a barbed end 63, both of which function to extend fluid passage 43. Drain cleaning apparatus 2 also includes a flexible tubular member or hose 70 having a first end portion 73 attached to control housing 5 through barbed end 63 of terminal connector 58, as well as perhaps a clamp 77 as at least indicated in FIG. 1, and a second end portion 80. Second end portion 80 of tubular member 70 has secured thereto an terminal connector 83. More specifically, terminal connector 83 includes a first attachment section 86 which receives and is crimped to second end portion 80, an angled tube 88 that interconnects first attachment section 86 with a second attachment section 91 and a rotary connector 93. Although not clearly shown in the drawings, rotary connector 93 can slide along second attachment section 91 and is internally threaded. In addition, an outer surface portion (not separately labeled) of rotary connector 93 is gnarled to aid in gripping the same.

Drain cleaning apparatus 2 further includes a terminal discharge member 97. In the preferred embodiment shown in FIGS. 1 and 2, terminal discharge member 97 includes a first leg 100 having an inlet 101 and external threads 102, a second leg 105 that is preferably angled with respect to first leg 100 and which leads to a generally conical end fitting 108. End fitting 108 is formed with an outlet 111 which is in fluid communication with fluid passage 43 through terminal discharge member 97 and tubular member 70 when drain cleaning apparatus 2 is fully assembled.

Cartridge housing 11 is adapted to receive a cartridge 116 that is pre-charged with a fluid medium. As shown, cartridge 116 has a tapered end 119 which terminates in a sealed tip 121. Cartridge 116 is adapted to be placed within housing 11 with a rounded bottom portion 124 of cartridge 116 being generally seated within an aperture 126 formed in a bottom of cartridge housing 11. Aperture 126 not only enables the presence or absence of cartridge 116 to be readily determined, but also aids in centering cartridge 116 in housing 11. Once cartridge 116 is positioned within cartridge housing 11, housing 11 can be mated with threads 33 provided on third section 27 of control housing 5. Tightening of cartridge housing 11 will cause O-ring 41 to seal about tapered end 119 and puncture member 36 to pierce sealed tip 121. This will cause the fluid medium to flow from cartridge 116 into fluid passage 43 and towards release valve member 45 at a rate controlled by regulating unit 50. Assuming that release valve member 45 is closed, the fluid chamber defined in fluid passage 43 between release valve member 45 and regulating unit 50 will become fully charged from the supply of fluid medium. At this point, drain cleaning apparatus 2 is ready for use.

During use, control housing 5 is adapted to be grasped by and held in one hand while terminal discharge member 97 is maneuvered into a desired position at an opening of a clogged drain conduit. Preferably, terminal discharge member 97 is formed from a relatively soft elastomeric material to aid in sealing terminal discharge member 97 relative to the drain conduit. Given the relative proximity between release valve member 45 and regulating unit 50 (for example, approximately two inches apart), both of these control elements can be easily manipulated. Once properly positioned and adjusted, shifting of release valve member 45 from the closed position to an open position will cause the pressurized fluid medium located in the fluid chamber to enter the drain conduit through the terminal discharge member 97 as a momentary burst of pressurized fluid. Meanwhile, regulating unit 50 will retard the flow of additional pressurized fluid from cartridge 116 into fluid passage 43. The degree to which regulating unit 50 retards this flow is selectively controlled by the operator through the manipulation of control knob 55. Therefore, the operator can open regulating unit 50 all the way and permit the entire contents of cartridge 116 to be released or can essentially close off cartridge 116 following the filling of the fluid chamber between release valve member 45 and regulating unit 50 to preserve the number of cleaning fluid bursts that can be obtained from a single cartridge 116.

Figure 3:
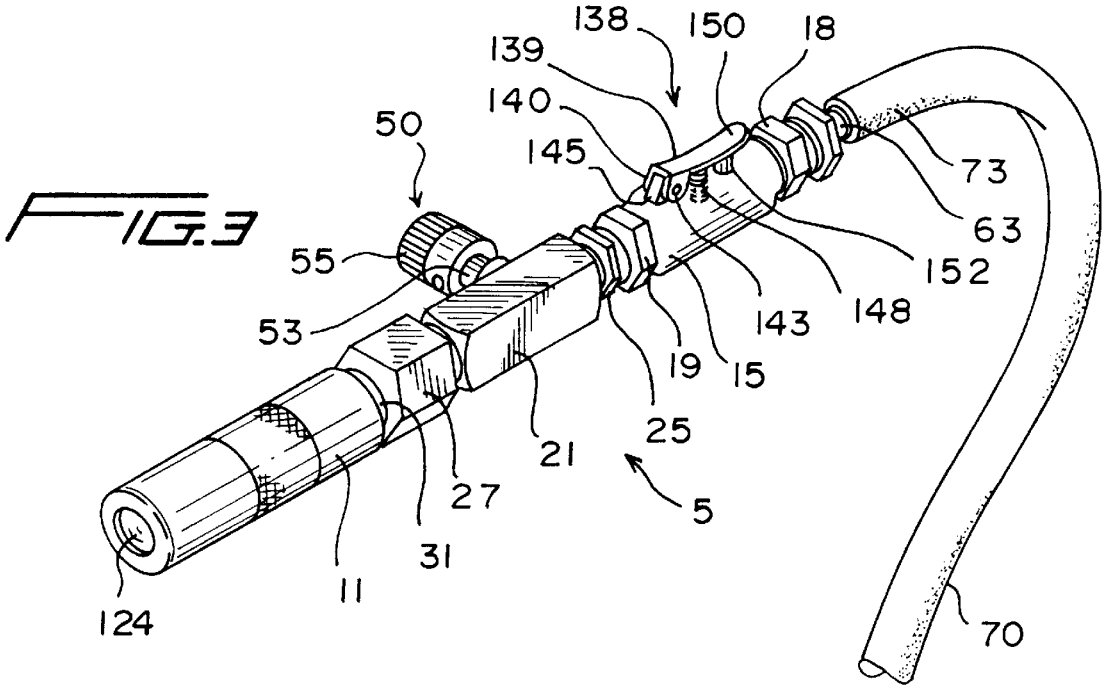
FIG. 3 is a perspective view of a drain cleaning apparatus constructed in accordance with a second preferred embodiment of the invention.

FIG. 3 illustrates another preferred embodiment constructed in accordance with the present invention. In general, this embodiment only differs from the embodiment of FIGS. 1 and 2 with respect to the construction of the release valve member and the terminal discharge member. As shown in FIG. 3, the release valve member is constituted by a push button-type actuator 138 including a push button element 139 having a bifricated end 140 that is pivotally connected through a pin 143 to a mounting block 145 formed on control housing 5. As shown, push button element 139 is biased by a spring 148 to a position which closes fluid passage 43 and includes a cantilevered end 150 that can be manually depressed to control a valve shifting member 152 to open fluid passage 43. In this embodiment, the terminal discharge member includes an expandable bladder section 157 which will automatically expand, commensurate with the flow of a pressurized fluid medium there through, to create an effective seal with the conduit to be cleaned. Since this embodiment of the invention functions in an identical manner to the prior disclosed embodiment, this description will not be reiterated here.

Figure 4:
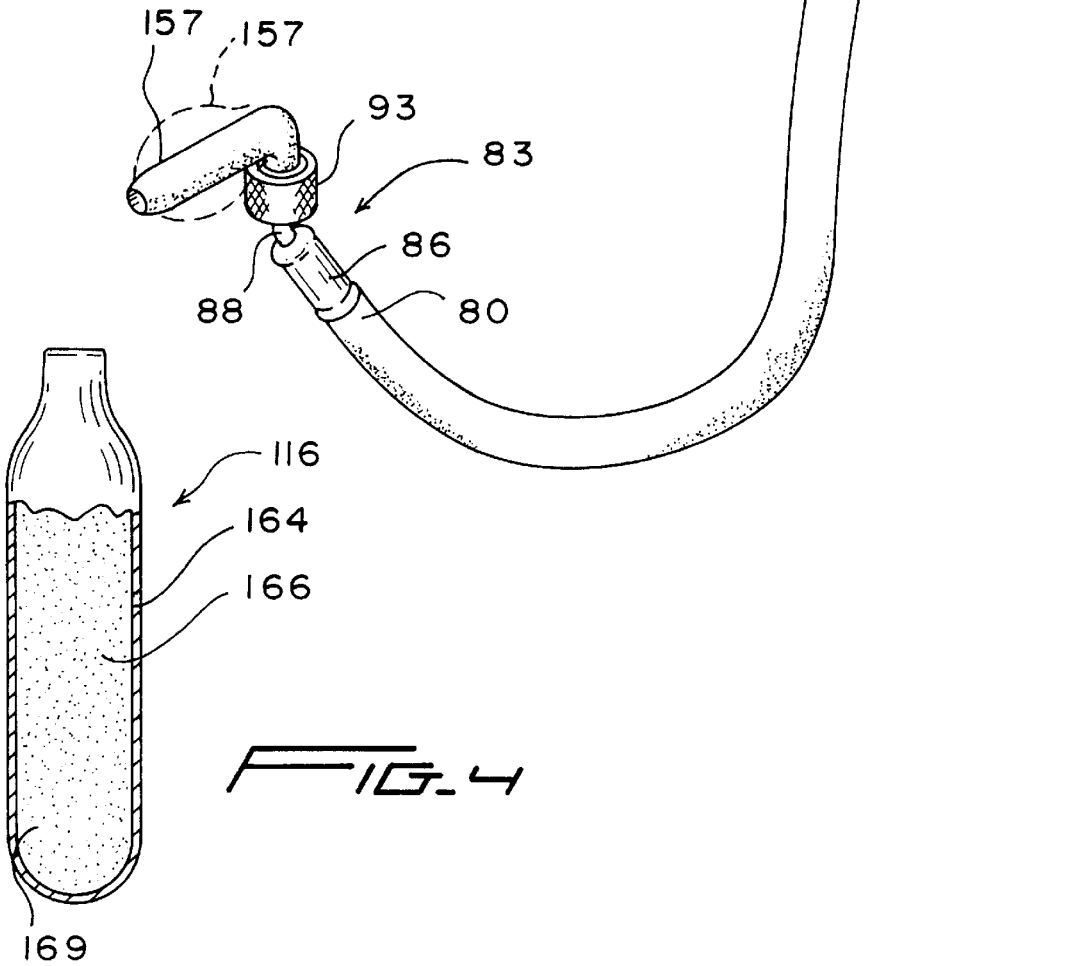
FIG. 4 is a partial cross-sectional view of a miniature pressurized cartridge adapted for use with the drain cleaning apparatuses of FIGS. 1–3.

FIG. 4 illustrates a preferred embodiment for cartridge 116. Cartridge 116 is preferably made of metal, although polymer materials could also be used, and has a relatively thin outer wall 164. As indicated above, cartridge 116 is pre-charged with a gaseous medium 166. The particular charging pressure could vary in accordance with the invention depending on the particular environment of use but, in general, cartridge 116 is pre-charged in the order of 800 psi. Furthermore, in accordance with the invention, cartridge 116 may contain, in addition to the gaseous medium 166 which could be carbon dioxide for example, a drain cleaning or algaecide substance as indicated at 169. Preferably, the drain cleaning or algaecide substance 169 would be in liquid form and would be atomized so as to be entrained within the gaseous medium 166 in a manner analogous to pre-charged perfume spray containers. The presence of drain cleaning or algaecide substance 169 will assure that the clogged drain is not only cleared but is treated against future occurrences.

From the above description, it should be readily apparent that the drain cleaning apparatus of the invention is compact, cost effective and advantageously useable in numerous environments. Although described with respect to preferred embodiments of the invention, it should be readily understood that various changes and/or modifications can be made to the invention without departing from the spirit thereof. For example, the pressurizing fluid source need not be limited to a miniature, pre-charged cartridge, but could comprise other pressurizing sources such as, for example, a somewhat larger pre-charged container or even a small hand pump provided at the end of the control housing in place of the cartridge housing. In general, the invention is only intended to be limited by the scope of the following claims.

I claim:

1. A portable drain cleaning apparatus comprising:

a control housing adapted to be grasped by and held in a user's hand, said control housing being provided with a fluid passage therein;

a release valve member disposed, at least in part, within said passage, said release valve member being movable between at least a first position wherein said release valve member prevents fluid from flowing within said passage and a second position wherein fluid is permitted to flow therein;

a flexible, tubular member having first and second end portions, the first end portion of said tubular member being attached to said control housing, downstream of said release valve member, with an interior of said tubular member opening into said fluid passage;

a terminal discharge member provided at the second end portion of said tubular member, said terminal discharge member being adapted to be sealingly engaged with an open end of a drain conduit and including an outlet opening in fluid communication with said fluid passage through said tubular member; and means for pressurizing said fluid passage upstream of said release valve member, said pressurizing means including a miniature cartridge, sized to substantially fit in the palm of a hand, that is pre-charged with a gaseous medium, wherein placement of said terminal discharge member at the open end of a drain conduit and shifting of said release valve member from said first position to said second position causes pressurized fluid in said fluid passage to flow through said tubular member and into the drain conduit in order to clean the drain conduit.

2. The drain cleaning apparatus according to claim 1, wherein said control housing includes a main body portion and a cartridge housing portion, said cartridge housing portion being adapted to receive at least a portion of said cartridge and be removably attached to said main body portion, said main body portion including a puncture member adapted to puncture said cartridge when said cartridge housing is secured to said main body portion.

3. The drain cleaning apparatus according to claim 1, wherein said cartridge contains, in addition to said gaseous medium, at least one of a drain cleaning fluid and an algaecide.

4. The drain cleaning apparatus according to claim 1, further comprising a regulating unit fluidly interposed between said pressurizing means and said release valve member, said regulating unit controlling the rate of flow of pressurized fluid from said pressurizing means, said regulating unit further being spaced from said release valve member so as to define, within said passage, a fluid chamber therebetween, wherein shifting of said release valve member from said first position to said second position causes a supply of pressurized fluid, delivered into said fluid chamber from said pressurizing means through said regulating unit to exit the second end portion of said tubular member as a momentary burst of pressurized fluid while said regulating unit retards a flow of additional pressurized fluid from said pressurizing means into said fluid chamber.

5. The drain cleaning apparatus according to claim 4, wherein said regulating unit is adjustable to alter the degree to which said regulating unit retards the flow of additional pressurized fluid.

6. The drain cleaning apparatus according to claim 1, wherein said release valve member comprises a rotary valve.

7. The drain cleaning apparatus according to claim 1, wherein said release valve member comprises a spring-biased, push button valve unit.

8. The drain cleaning apparatus according to claim 1, wherein said terminal discharge member comprises a generally, conically-shaped terminal end portion.

9. The drain cleaning apparatus according to claim 1, wherein said terminal discharge member includes a section adapted to radially expand in response to pressurized fluid flowing through said terminal discharge member.

10. A portable drain cleaning apparatus comprising:

a flexible, tubular member having first and second end portions;

a pressurized container having an outlet in fluid communication with the first end portion of said tubular member, said pressurized container being constituted by a miniature cartridge which is pre-charged with a gaseous medium;

a release member interposed between the outlet of said pressurized container and the second end portion of said tubular member, said release member being shiftable between a closed position wherein pressurized fluid is prevented from flowing through said tubular member and an open position wherein pressurized fluid is permitted to flow through said tubular member;

a regulating unit fluidly interposed between said pressurized container and said release member, said regulating unit being adjustable to control a rate of flow of pressurized fluid from said pressurized container, said regulating unit further being spaced from said release member so as to define a fluid chamber therebetween, wherein shifting of said release member from said closed position to said open position causes a supply of pressurized fluid, delivered into said fluid chamber from said pressurized container through said regulating unit, to exit the second end portion of said tubular member as a momentary burst of pressurized fluid while said regulating unit retards a flow of additional pressurized fluid from said pressurized container into said fluid chamber; and a control housing to which said release member and said regulating unit are attached, said control housing including a fluid passage therein with a portion of said fluid passage defining said fluid chamber, said control housing further including a main body portion and a cartridge housing portion, said cartridge housing portion being adapted to receive at least a portion of said cartridge and be removably attached to said main body portion, said main body portion including a puncture member adapted to puncture said cartridge when said cartridge housing is secured to said main body portion.

11. The drain cleaning apparatus according to claim 10, wherein said cartridge contains, in addition to said gaseous medium, at least one of a drain cleaning fluid and an algaecide.

12. The drain cleaning apparatus according to claim 10, wherein said release member comprises a rotary valve.

13. The drain cleaning apparatus according to claim 10, wherein said release member comprises a spring-biased, push button valve unit.

14. The drain cleaning apparatus according to claim 10, further comprising a terminal discharge member provided at the second end portion of said tubular member, said terminal discharge member including a generally, conically-shaped terminal end portion adapted to be sealingly engaged with an open end of a drain conduit and including an outlet opening in fluid communication with said fluid chamber through said tubular member.

15. The drain cleaning apparatus according to claim 10, further comprising a terminal discharge member provided at the second end portion of said tubular member, said terminal discharge member including a section adapted to radially expand in response to said pressurized fluid flowing through said terminal discharge member, said section being adapted to be sealingly engaged with an open end of a drain conduit and including an outlet opening in fluid communication with said fluid chamber through said tubular member.

16. A portable drain cleaning apparatus comprising:

a control housing adapted to be grasped by and held in a user's hand, said control housing being provided with a fluid passage therein;

a release valve member disposed, at least in part, within said passage, said release valve member being movable between at least a first position wherein said release valve member prevents fluid from flowing within said passage and a second position wherein fluid is permitted to flow therein;

a flexible, tubular member having first and second end portions, the first end portion of said tubular member being attached to said control housing, downstream of said release valve member, with an interior of said tubular member opening into said fluid passage;

a terminal discharge member provided at the second end portion of said tubular member, said terminal discharge member being adapted to be sealingly engaged with an open end of a drain conduit and including an outlet opening in fluid communication with said fluid passage through said tubular member; and a miniature cartridge, sized to substantially fit in the palm of a hand, adapted to be replaceably positioned in the control housing, said cartridge being pre-charged with a gaseous medium for pressurizing said fluid passage upstream of said release valve member, wherein placement of said terminal discharge member at the open end of a drain conduit and shifting of said release valve member from said first position to said second position causes pressurized fluid in said fluid passage to flow through said tubular member and into the drain conduit in order to clean the drain conduit.

17. The drain cleaning apparatus according to claim 16, wherein said control housing includes a main body portion and a cartridge housing portion, said cartridge housing portion being adapted to receive at least a portion of said cartridge and be removably attached to said main body portion, said main body portion including a puncture member adapted to puncture said cartridge when said cartridge housing is secured to said main body portion.

18. The drain cleaning apparatus according to claim 16, wherein said cartridge contains, in addition to said gaseous medium, at least one of a drain cleaning fluid and an algaecide.

19. The drain cleaning apparatus according to claim 16, wherein said release valve member comprises a spring-biased, push button valve unit.

20. The drain cleaning apparatus according to claim 16, wherein said terminal discharge member comprises a generally, conically-shaped terminal end portion.

* * * * *

US005803101C1

(12) EX PARTE REEXAMINATION CERTIFICATE (6155th)

United States Patent
Gallo

(10) Number: US 5,803,101 C1
(45) Certificate Issued: Mar. 18, 2008

(54) PORTABLE DRAIN CLEANING APPARATUS

(75) Inventor: Charles V. Gallo, Blacksburg, VA (US)

(73) Assignee: Diversitech Corporation, Decatur, GA (US)

Reexamination Request:
No. 90/007,346, Dec. 20, 2004

Reexamination Certificate for:

| | |
|---|---|
| Patent No.: | **5,803,101** |
| Issued: | **Sep. 8, 1998** |
| Appl. No.: | **08/712,192** |
| Filed: | **Sep. 11, 1996** |

(51) Int. Cl.
*B08B 9/00* (2006.01)
*B08B 9/04* (2006.01)

(52) U.S. Cl. ..... 134/166 C; 4/255.06; 15/406; 134/22.12; 134/24

(58) Field of Classification Search ..... None
See application file for complete search history.

(56) References Cited

U.S. PATENT DOCUMENTS

| | | | | | |
|---|---|---|---|---|---|
| 1,537,313 | A | * | 5/1925 | Koudelka | 15/316.1 |
| 1,745,923 | A | | 2/1930 | Frizell | |
| 1,836,101 | A | | 12/1931 | Young | |
| 2,016,498 | A | * | 10/1935 | Hopewell | 4/255.07 |
| 2,021,603 | A | | 11/1935 | Kelley et al. | |
| 2,048,852 | A | | 7/1936 | Dumas | |
| 2,284,805 | A | * | 6/1942 | Decker | 15/406 |
| 2,300,319 | A | * | 10/1942 | Smith | 4/255.01 |
| 2,939,154 | A | * | 6/1960 | Gasser | 4/255.01 |
| 3,138,803 | A | * | 6/1964 | Caplan et al. | 4/255.01 |
| 3,139,238 | A | * | 6/1964 | Norstrud et al. | 239/310 |
| 3,156,584 | A | * | 11/1964 | Yurdin | 134/17 |
| 3,189,934 | A | | 6/1965 | Steinwedel | |
| 3,280,419 | A | * | 10/1966 | Frohlich | 15/406 |
| 3,426,774 | A | | 2/1969 | Conn | |
| 3,608,098 | A | * | 9/1971 | Andrisani | 4/255.04 |
| 3,707,301 | A | * | 12/1972 | Rauls | 285/9.2 |
| 3,789,861 | A | * | 2/1974 | Conn et al. | 134/166 C |
| 3,823,427 | A | * | 7/1974 | Pittet | 4/255.01 |
| 3,879,771 | A | * | 4/1975 | Nakane | 4/255.01 |
| 4,034,427 | A | * | 7/1977 | Breznock et al. | 4/255.01 |
| 4,059,858 | A | * | 11/1977 | Lambel et al. | 4/255.01 |
| 4,063,317 | A | * | 12/1977 | Santore | 4/255.01 |
| 4,321,712 | A | * | 3/1982 | Dixon | 4/255.04 |
| 4,420,852 | A | * | 12/1983 | Bowlsby | 15/104.33 |
| 4,791,946 | A | * | 12/1988 | Cavanaugh et al. | 134/99.1 |
| 5,029,594 | A | * | 7/1991 | Pierce, Jr. | 134/102.2 |
| 5,249,311 | A | * | 10/1993 | Rau | 4/255.05 |
| 5,287,564 | A | | 2/1994 | Davenport | |
| 5,351,710 | A | | 10/1994 | Phillips | |
| 5,530,988 | A | * | 7/1996 | McQuillan | 15/406 |
| 5,544,670 | A | | 8/1996 | Phillips et al. | |
| 5,590,696 | A | | 1/1997 | Phillips et al. | |
| 5,666,690 | A | | 9/1997 | Domansky | |
| 5,787,516 | A | | 8/1998 | Davenport | |

* cited by examiner

*Primary Examiner*—Krisanne Jastrzab

(57) ABSTRACT

A readily transportable, compact and self-contained drain cleaning apparatus includes a hand-held control housing that is provided with an internal passage into which a release member and an adjustable regulating unit extend at spaced intervals such that a fluid chamber is defined between the release member and the regulating unit within the internal passage. The control housing includes a cartridge housing portion for attaching a miniature cartridge, containing a pressurized gaseous medium and preferably either a drain cleaning or algaecide fluid, thereto with an interior of the cartridge opening into the internal passage downstream of the regulating unit. Upstream of the release member, the control housing has an elongated tube attached thereto and the tube has an end, remote from the control housing, provided with a terminal discharge member that is adapted to be sealingly engaged with an open portion of a clogged drain conduit. With this construction, shifting of the release member causes a supply of pressurized fluid, delivered into the fluid chamber from the pressurized cartridge through the regulating unit, to flow through the tube and terminal discharge member and into the drain conduit as a momentary burst of pressurized fluid while the regulating unit retards a flow of additional pressurized fluid from the cartridge to the fluid chamber.

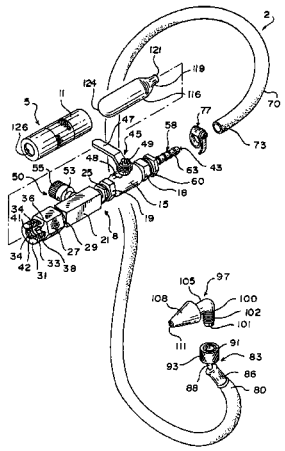

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 4–5 and 10–15 is confirmed. Claims 1–3, 6–9 and 16–20 are cancelled.

* * * * *

US005803101C2

(12) EX PARTE REEXAMINATION CERTIFICATE (9722nd)

United States Patent
Gallo

(10) Number: US 5,803,101 C2
(45) Certificate Issued: Jun. 26, 2013

(54) PORTABLE DRAIN CLEANING APPARATUS

(75) Inventor: Charles V. Gallo, Blacksburg, VA (US)

(73) Assignee: Diversitech Corporation, Decatur, GA (US)

Reexamination Request:
No. 90/011,332, Nov. 15, 2010

Reexamination Certificate for:

| | |
|---|---|
| Patent No.: | **5,803,101** |
| Issued: | **Sep. 8, 1998** |
| Appl. No.: | **08/712,192** |
| Filed: | **Sep. 11, 1996** |

Reexamination Certificate C1 5,803,101 issued Mar. 18, 2008

(51) Int. Cl.

| | |
|---|---|
| ***B08B 9/02*** | (2006.01) |
| ***B08B 3/02*** | (2006.01) |
| ***E03C 1/12*** | (2006.01) |
| ***E03F 9/00*** | (2006.01) |
| ***E03C 1/304*** | (2006.01) |
| ***B08B 9/032*** | (2006.01) |

(52) U.S. Cl.
CPC . *B08B 3/02* (2013.01); *E03C 1/304* (2013.01); *B08B 9/0321* (2013.01); *E03F 9/00* (2013.01)
USPC ..... 134/166 C; 134/24; 134/22.12; 4/255.06; 15/406

(58) Field of Classification Search
None
See application file for complete search history.

(56) References Cited

To view the complete listing of prior art documents cited during the proceeding for Reexamination Control Number 90/011,332, please refer to the USPTO's public Patent Application Information Retrieval (PAIR) system under the Display References tab.

*Primary Examiner* — Elizabeth McKane

(57) ABSTRACT

A readily transportable, compact and self-contained drain cleaning apparatus includes a hand-held control housing that is provided with an internal passage into which a release member and an adjustable regulating unit extend at spaced intervals such that a fluid chamber is defined between the release member and the regulating unit within the internal passage. The control housing includes a cartridge housing portion for attaching a miniature cartridge, containing a pressurized gaseous medium and preferably either a drain cleaning or algaecide fluid, thereto with an interior of the cartridge opening into the internal passage downstream of the regulating unit. Upstream of the release member, the control housing has an elongated tube attached thereto and the tube has an end, remote from the control housing, provided with a terminal discharge member that is adapted to be sealingly engaged with an open portion of a clogged drain conduit. With this construction, shifting of the release member causes a supply of pressurized fluid, delivered into the fluid chamber from the pressurized cartridge through the regulating unit, to flow through the tube and terminal discharge member and into the drain conduit as a momentary burst of pressurized fluid while the regulating unit retards a flow of additional pressurized fluid from the cartridge to the fluid chamber.

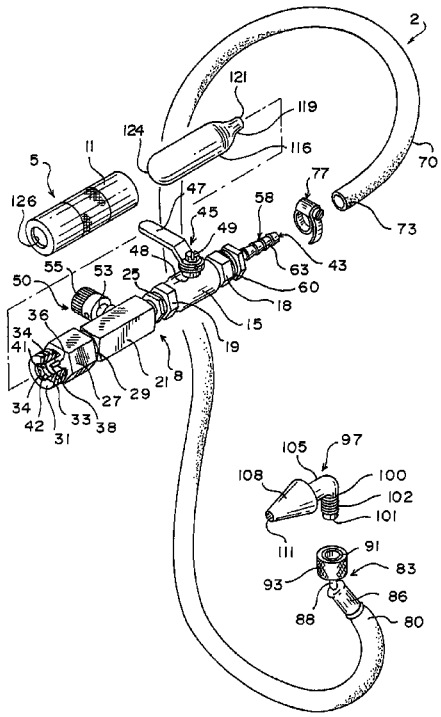

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 4, 5 and 10-15 is confirmed.

Claims 1-3, 6-9 and 16-20 were previously cancelled.

* * * * *